US008656547B2

(12) United States Patent
Zanetti et al.

(10) Patent No.: US 8,656,547 B2
(45) Date of Patent: Feb. 25, 2014

(54) BILLIARDS CHALK DUST REMOVAL TOOL

(75) Inventors: Marco Zanetti, Bozen (IT); Bernard Bollette, Olne (BE); Ivan Lee, Hawthorn Woods, IL (US)

(73) Assignee: Iwan Simonis Incorporated, Libertyville, IL (US)

( * ) Notice: Subject to any disclaimer, the term of this patent is extended or adjusted under 35 U.S.C. 154(b) by 139 days.

(21) Appl. No.: 13/267,742

(22) Filed: Oct. 6, 2011

(65) Prior Publication Data

US 2012/0084929 A1 Apr. 12, 2012

Related U.S. Application Data

(60) Provisional application No. 61/390,985, filed on Oct. 7, 2010.

(51) Int. Cl.
*A63D 15/00* (2006.01)
*A47L 13/40* (2006.01)

(52) U.S. Cl.
USPC ..... 15/210.1; 15/1.52

(58) Field of Classification Search
USPC ..... 15/210.1, 1.52, 118
See application file for complete search history.

(56) References Cited

U.S. PATENT DOCUMENTS 2,322,986 A * 6/1943 Weiss et al. ..... 15/1.51
4,543,680 A * 10/1985 Vlahos ..... 15/145

* cited by examiner

*Primary Examiner* — Shay Karls
(74) *Attorney, Agent, or Firm* — McDonald Hopkins LLC

(57) ABSTRACT

The present invention relates to a billiards chalk dust removal tool. The billiards chalk dust tool is brushed across the baize on a billiard table for cleaning the chalk dust out of the baize periodically to preserve the level of playing conditions on the billiard table.

11 Claims, 5 Drawing Sheets

BILLIARDS CHALK DUST REMOVAL TOOL

CROSS-REFERENCE TO RELATED APPLICATIONS

This application claims benefit from U.S. Provisional Patent Application No. 61/390,985 entitled "BILLIARDS CHALK DUST REMOVAL TOOL" filed on Oct. 7,2010.

FIELD OF INVENTION

The present invention relates to a billiards tool. More particularly, the present invention relates to a billiards chalk dust tool for cleaning the chalk dust out of a billiard table periodically to preserve the level of play on the billiard table.

BACKGROUND OF THE INVENTION

In the game of billiards, all types of tables are covered with billiard cloth. The cloth is sometimes called a felt. However, the cloth is generally a woven wool or wool/nylon blend called baize. This cloth is used to cover the billiard tables. In some instances where competition cloth was desired a higher quality of billiard cloth was used either 100% worsted wool or a 90% wool and 10% nylon blend for the balls to roll across the billiard table with less friction. The cloth of the billiard table was traditionally green with colors such as red and blue also being used.

The billiard cloth stretched across the billiard table collects a significant amount of chalk dust from billiard players during a game. Players often chalk the end of their cue stick after each shot to promote just the right amount of friction and spin on the cue ball when striking the cue ball to control the cue ball during a shot. As the cue stick is chalked several times during the course of the game and even after each shot by some players, the players often chalk the cue stick around the playing area. Many players will chalk their cue stick over the billiard table itself as they walk around the table to line up a shot.

The player typically does not give it a second thought about the accumulation of chalk dust when chalking the cue stick over the table. However, the professional player will notice the chalk dust kick up on the table when making a shot. The professional player believe that the chalk dust might interfere with the progression of the struck cue ball and the billiard ball struck by the cue ball during a shot when both balls travel over the surface of the billiard cloth that includes an accumulation of chalk dust within the billiard cloth. Thus, the accumulation of chalk dust can interfere with the normal play on a billiard table cloth having an accumulation of the chalk dust built up within the billiard cloth. Billiard cloths or baize that generally consists of a wool and/or polyester blend with materials are susceptible to a chalk dust buildup.

Moreover, a great amount of chalk dust is created as the cue stick is repeatedly chalked. Since most chalk is generally a bright color like blue or green chalk, the chalk that accumulates on the surface of the billiard cloth may stain the billiard pockets on the table or even cause premature failure of the billiard cloth itself.

The buildup of particles from chalk on the cloth as applied to the tip of the cue stick before every shot to increase the tip's friction coefficient will affect the ball roll across the table and require frequent cloth cleaning to reduce the amount of chalk on the billiard table.

Thus, there is a need for a device or tool which enables billiard chalk dust to be conveniently removed easily from the baize without the inconvenience, mess and potential damage to the baize from brushes, vacuum cleaners and other existing tools that wear out the fabric of the cloth or drive the chalk dust deeper into the weave of a billiard cloth material chosen for the particular billiard table and its use in a general public billiard room versus a tournament competition. The present invention fulfills this need and provides other related advantages.

SUMMARY OF THE INVENTION

The present invention resides in a billiards chalk dust tool generally comprising a housing designed to be manipulated by the hand of the end user across the top of a billiard table cloth, the housing formed from a first material having a generally flat rectangular portion of a predetermined thickness including a top surface and a bottom surface, an X-shaped dome generally formed from said first material having an inner and a outer surface including four legs extending generally from the four corners of the rectangular portion to a center axis of the dome over the top surface of the rectangular portion and each leg fixedly attached generally at one of the top surface corners, a support member connected to the top surface at one end and extending upwardly inline with the center axis of the dome from a point generally equidistance from each pair of opposing sides of the rectangular top surface attached to the inner surface at the middle axis of the dome to further secure the dome to the rectangular portion, the outer surface of the dome having an inlay edge along the perimeter of the outer surface defining a first predetermined area, a generally second material inset within the inlay edge to fill the predetermined area and fixedly attached to the outer surface of the dome, an opening between the top surface of the rectangular portion and the dome on each side of the rectangular portion for insertion of digit from a hand to grip and manipulate the tool by the end user, an inlay edge generally along the perimeter of bottom surface of the rectangular portion defining a second predetermined area, a chalk dust absorbing material inset within the inlay edge to fill the second predetermined area.

The first material of the housing and dome is comprised of a plastic, nylon, wood, rubber or other material that holds its shape when manipulated by the user hand as the billiard chalk dust tool is dragged or pushed across the cloth of a billiard table to collect the chalk dust. The second material covers a predetermined area of the top surface and the second material is made of cork or a cork like material for gripping the tool without slipping in the users hand and wherein the cork like material is gentle on the user hand when manipulating the tool across the cloth fabric of the billiard table to collect chalk dust.

The chalk dust absorbing material absorbs the chalk dust by a capillary action as the material is rubbed across the baize of the billiard table collecting the chalk dust. The chalk dust absorbing material is made from polyester, cotton, or other fiber that creates an electrostatic action between the absorbing material and the baize to lift out the chalk dust in the baize and capture it within the fibers when it is rubbed over the baize. When the absorbing material is filled to capacity, the end user can simply take the tool and place it over a waste disposal bin or the like and gently pat the material with a glove covered hand to discharge the chalk dust into the waste disposal bin until the discharge of chalk dust ceases. Then the tool is ready to be used again to clean the baize of a billiard table from accumulated chalk dust.

Other features and advantages of the present invention will become apparent from the following more detailed description, taken in conjunction with the accompanying drawings which illustrate, by way of example, the principles of the invention.

DESCRIPTION OF THE DRAWINGS

To understand the present invention, it will now be described by way of example, with reference to the accompanying drawings in which.

DETAILED DESCRIPTION

While this invention is susceptible of embodiments in many different shape and size, the present invention is shown and described in the attached drawings.

Figure 1:
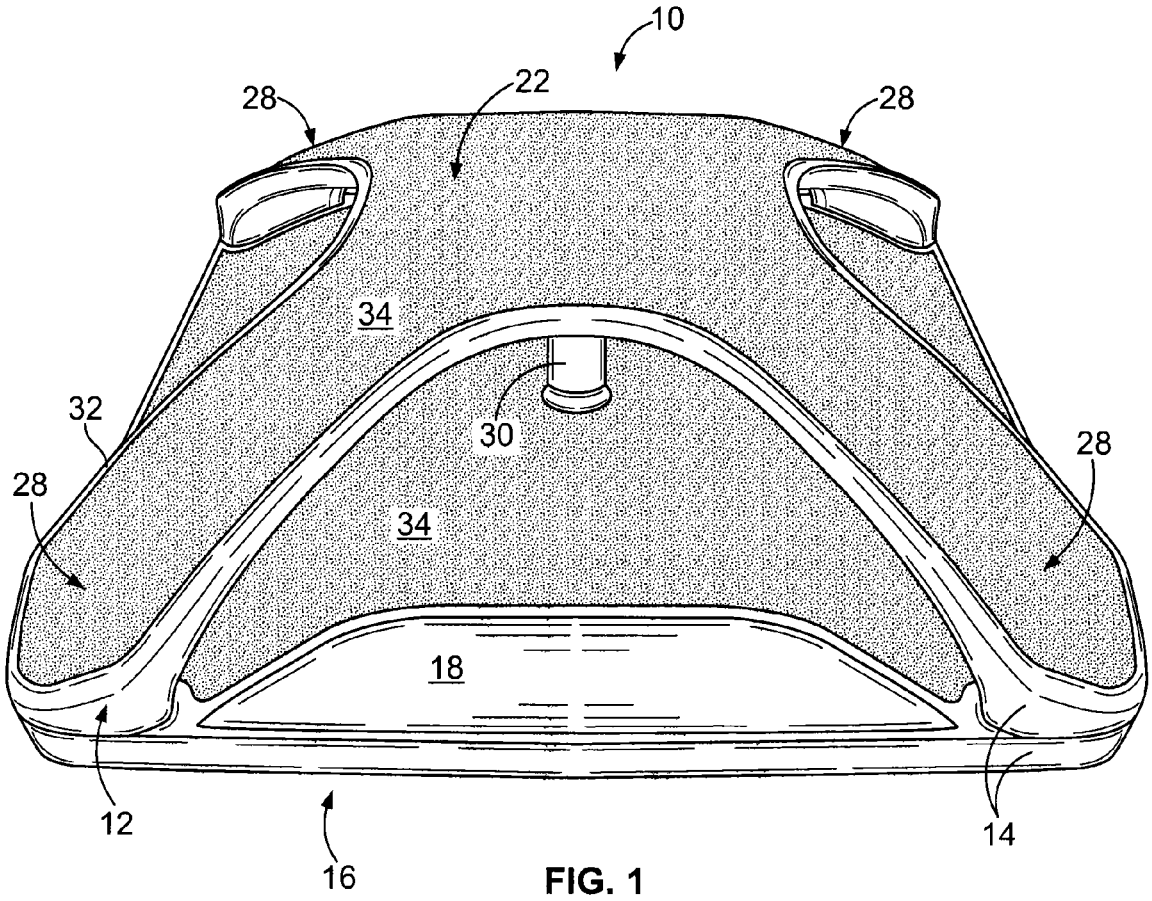
FIG. 1 is a perspective view of a billiards chalk dust removal tool.

FIG. 1 illustrates a billiard chalk dust removal tool 10. The billiards chalk dust removal tool 10 generally comprises a housing 12 designed to be manipulated by the hand of the end user across the top of a billiard table cloth, the housing 12 formed from a first material 14 having a generally flat rectangular portion or body 16 of a predetermined thickness including a top surface 18 and a bottom surface 20, an X-shaped dome 22 generally formed from said first material 14 having an inner surface 24 and a outer surface 26 including four legs 28 of similar dimensions extending generally from the four corners of the rectangular portion to a center axis of the dome over the top surface of the rectangular portion and each leg fixedly attached generally at one of the top surface corners, a support member 30 connected to the top surface at one end and extending upwardly inline with the center axis of the dome 22 from a point generally equidistance from each pair of opposing sides of the rectangular top surface attached to the inner surface at the middle axis of the dome 22 to further secure the dome 22 to the rectangular portion 16, the outer surface 26 of the dome 22 having an inlay edge 32 along the perimeter of the outer surface defining a first predetermined area, a generally second material 34 inset within the inlay edge 32 to fill the predetermined area and fixedly attached to the outer surface of the dome 26, an opening 34 between the top surface 18 of the rectangular portion 16 and the dome 20 on each side of the rectangular portion 16 for insertion of digit from a hand to grip and manipulate the tool by the end user, an inlay edge 36 generally along the perimeter of bottom surface of the rectangular portion defining a second predetermined area, a chalk dust absorbing material 38 inset within the inlay edge 36 to fill the second predetermined area.

Figure 2:
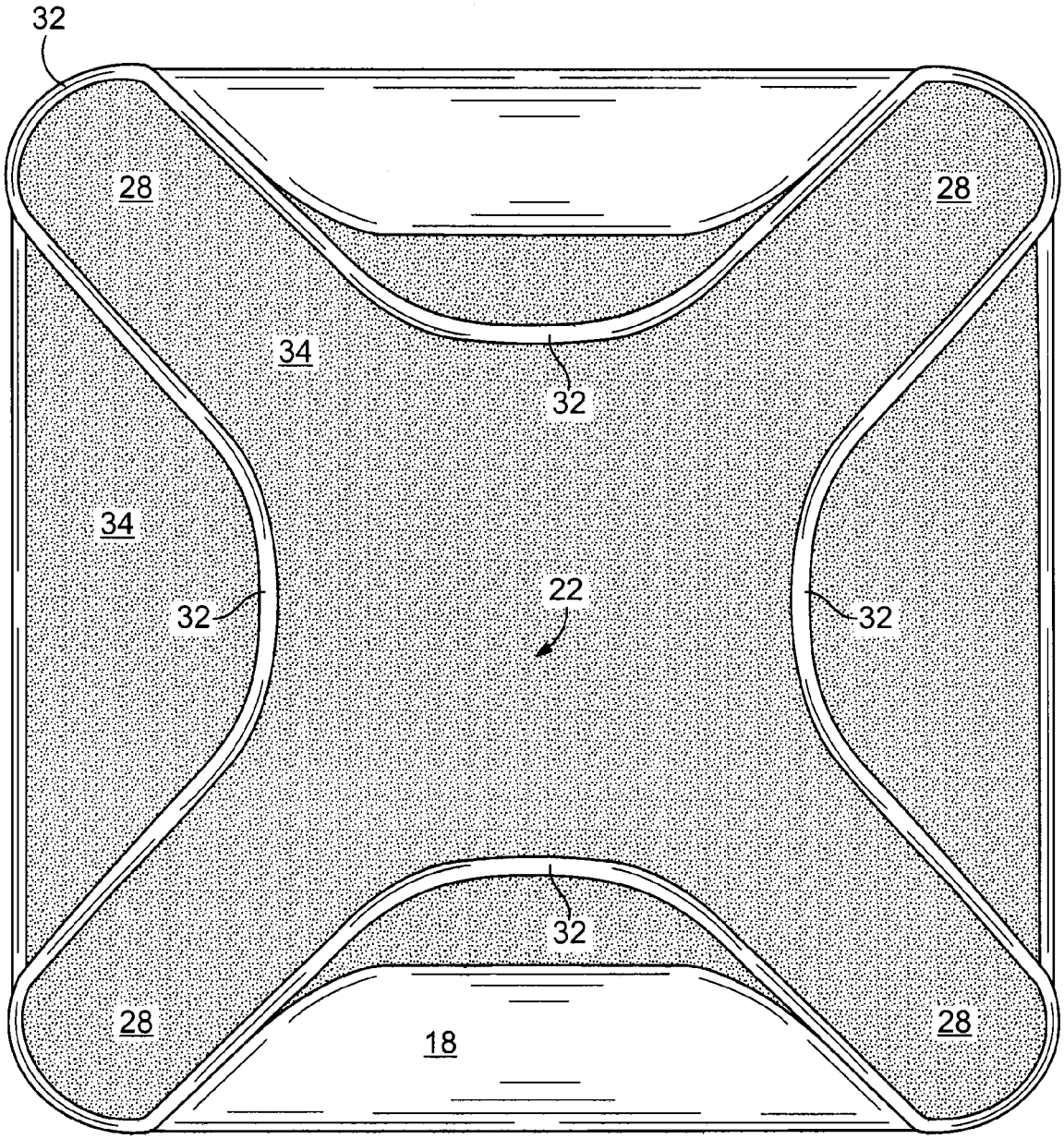
FIG. 2 is a top plan view of the billiards chalk dust removal tool of FIG. 1.

FIG. 2 illustrates a top view of the tool 10 in which the cork inlay 34 on the outer surface of the X-Shaped dome 22 within the inlay edge 32. The rectangular portion 16 includes the cork material 34 covering a predetermined portion thereof.

Figure 3:
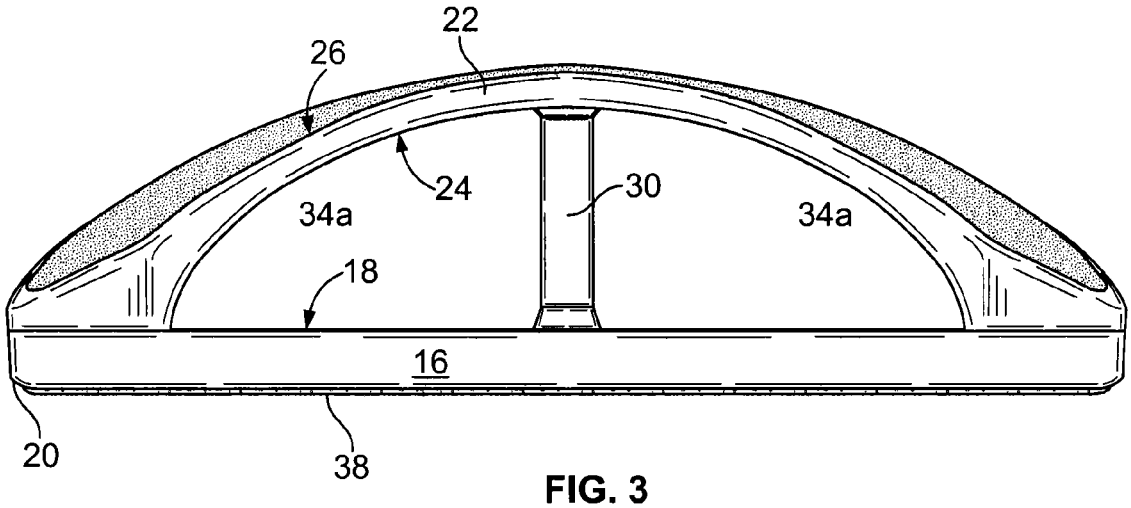
FIG. 3 is a front elevation view of the billiards chalk dust removal tool of FIG. 1.

FIG. 3 illustrates a front elevation view of the tool 10 where the cork inlay material 34 is shown on the outer surface 26 of the dome 22. The support member 30 extends between the top surface 18 and the inner surface 24 of the dome 22. The rectangular portion 16 is shown to be of a predetermined thickness so the chalk dust absorbent material 38 is inset in the bottom surface 20 within the inlay edge 36 to extend over the majority of the bottom surface 20. The absorbent material 38 throw a friction and capillary action lifts the chalk dust off the baize of the billiard table as the end user of the tool 10 brushes the absorbent material 38 across the baize of the billiard table.

Figure 4:
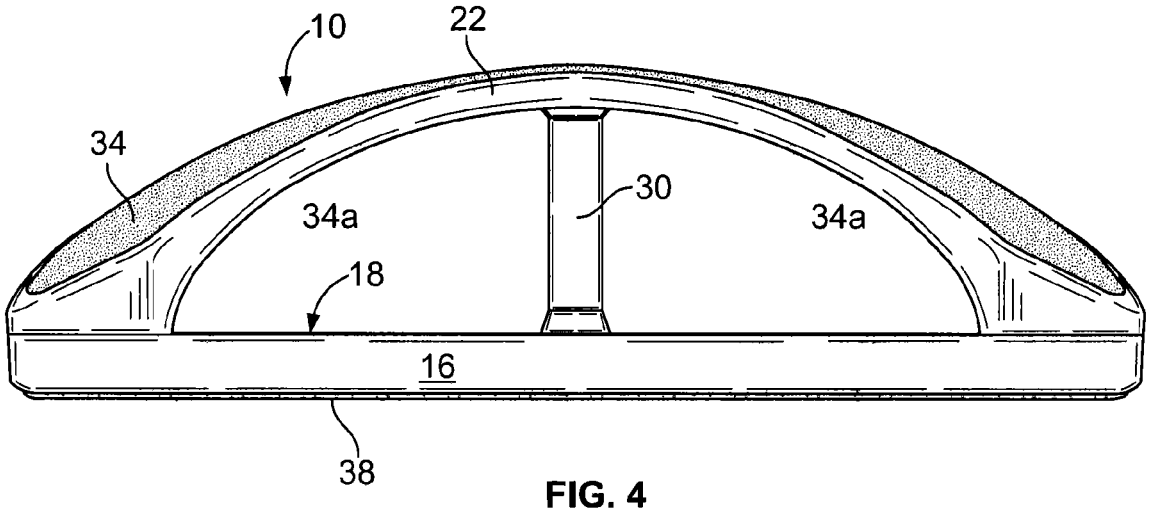
FIG. 4 is a rear elevation view of the billiards chalk dust removal tool of FIG. 1.

FIG. 4 illustrates the rear elevation view of the tool 10 and again shows similar structure of the tool 10 as shown in FIG. 3.

Figure 5:
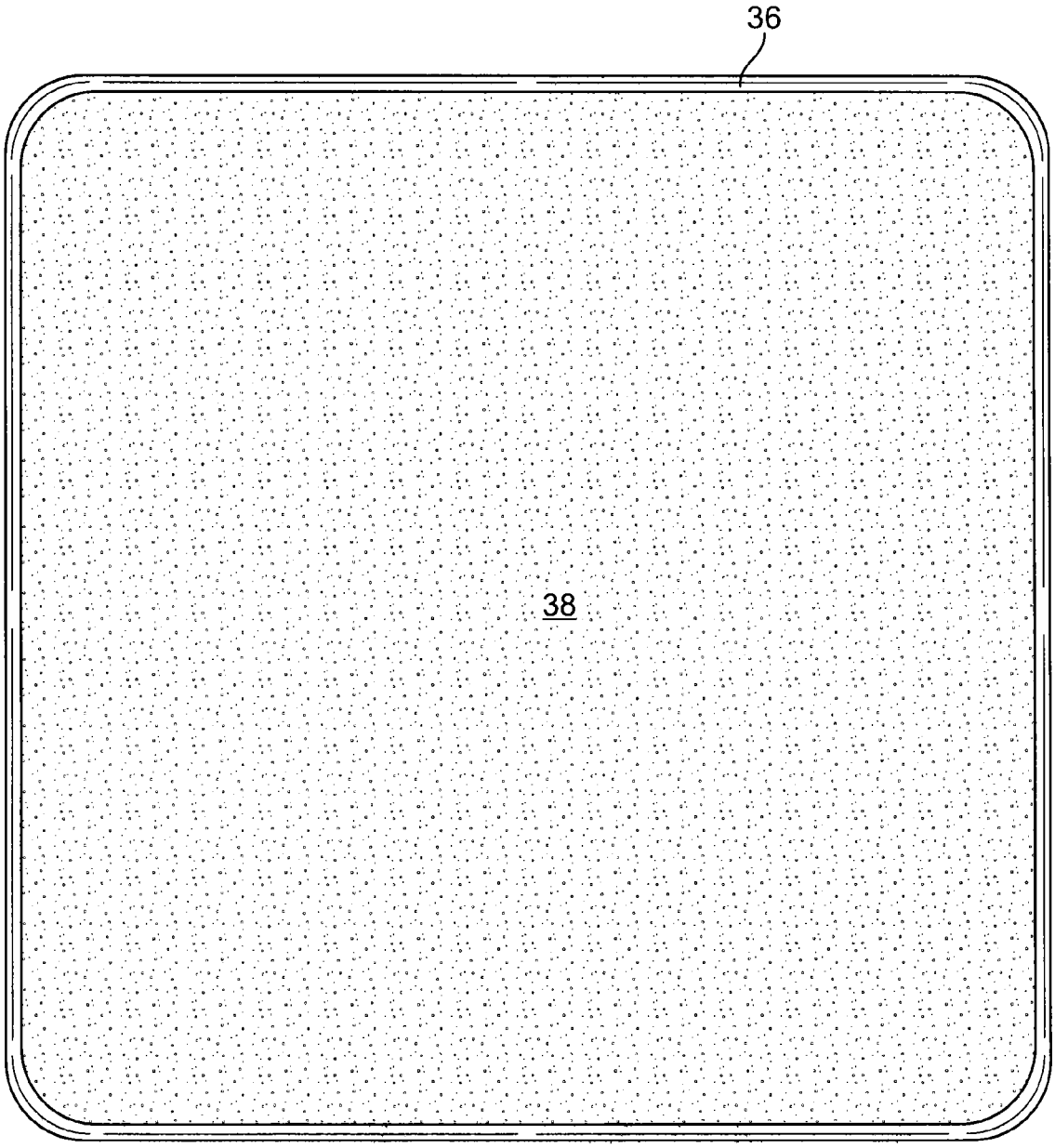
FIG. 5 is a bottom view of the billiards chalk dust removal tool showing the absorbent chalk dust material of FIG. 1.

FIG. 5 illustrates the bottom view of the tool 10 and shows the absorbent material 38 inset with the inlay edge 36 around the perimeter of the bottom surface 20. The material again is able through a capillary and friction action to lift off the chalk dust from the baize material of the billiard table. The end user inserts his/her hand with its digits gripping the X-shaped dome 22 and curling around the legs 28, which allows the end user to move the tool across the baize of a billiard table causing the chalk dust through the capillary action to lift off of the material and fill in amongst the fibers of the absorbent pad material 38. When the material becomes filled with chalk dust, the end user simply shakes or pats the absorbent pad material to shake out the chalk dust particles and then is able to reuse the tool. Although the absorbent material 38 may become discolored by the chalk dust over usage and time, the color change has no effect on the usefulness of the tool 10 and the repeated emptying of the chalk dust out of the material.

Although a particular embodiment of the invention has been described in detail for purposes of illustration, various modifications may be made without departing from the spirit and scope of the invention. Accordingly, the invention is not to be limited, except as by the appended claims. The tool 10 may also be able to take many different shapes and configurations so long as the frictional capillary action occurs, the chalk dust will be removed form the baize in keeping with this invention.

Having thus described the invention, we claim:

1. A billiard chalk dust removal tool, comprising:

a housing 12 having a generally flat rectangular portion 16 of a predetermined thickness including a top surface 18 and a bottom surface 20, an X-shaped dome 22 generally formed from a first material 14 having an inner surface 24 and a outer surface 26 including four legs 28 of similar dimensions extending generally upwardly from the four corners of the rectangular portion 16 to a center axis of the dome extending over the top surface 18 of the rectangular portion 16, each leg 28 fixedly attached generally at one of the four corners on top surface 18 of the rectangular portion 16, a support member 30 connected to the top surface 18 at one end and extending upwardly inline with the center axis of the dome 22 from a point generally equidistance from each pair of opposing sides of the rectangular top surface 18 attached to the inner surface 24 at the center axis of the dome 22 to further secure the dome 22 to the rectangular portion 16, the outer surface 26 of the dome 22 having an inlay edge 32 along the perimeter of the outer surface defining a first predetermined area, a generally second material 34 inset within the inlay edge 32 to fill the predetermined area and fixedly attached to the outer surface of the dome 22, an opening 34*a* between the top surface 18 of the rectangular portion 16 and the dome 22 on each side of the rectangular portion 16 for insertion of digit from a hand to grip and manipulate the tool by the end user, an inlay edge 36 generally along a perimeter of bottom surface 20 of the rectangular portion 16 defining a second predetermined area, a chalk dust absorbing pad material 38 inset within the inlay edge 36 to fill the second predetermined area wherein.

2. The billiard chalk dust tool of claim 1, wherein the first material is a plastic, nylon, wood, rubber or other material that holds its shape when manipulated by a user hand as the billiard chalk dust tool is dragged or pushed across a billiard cloth on a billiard table to collect chalk dust.

3. The billiard chalk dust tool of claim 1, wherein the second material is a cork inlay.

4. The billiard chalk dust tool of claim 1, wherein the absorbent material 38 creates a friction and capillary action that lifts the chalk dust off a baize of a billiard table as the end user of the tool 10 brushes the absorbent material 38 across the baize of the billiard table.

5. The billiard chalk dust tool of claim 1, wherein the absorbent material is a polyester, cotton, or other fiber that creates an electrostatic action between the absorbing material and a baize to lift out the chalk dust in the baize and capture the chalk dust within the fiber when the absorbent material is rubbed over the baize of a billiard table.

6. The billiard chalk dust tool of claim 1, wherein and end user inserts his or her hand with its digits gripping the X-shaped dome 22 and curling digits around the legs 28, which allows the end user to move the tool across a baize of a billiard table causing chalk dust through the capillary action to lift off of the baize material of a billiard table and fill in amongst the fibers of the absorbent material 38.

7. The billiard chalk dust tool of claim 1, wherein the absorbent material 38 is filled with chalk dust, an end user simply shakes or pats the absorbent pad material to shake out the chalk dust particles and then is able to reuse the tool.

8. The billiard chalk dust tool of claim 1, wherein the absorbent material 38 is discolored by the chalk dust over usage and time, the color change has no effect on the usefulness of the tool 10 after repeated emptying of the chalk dust out of the absorbent material.

9. A billiard chalk dust removal tool 10, comprising:

a housing 12 formed from a first material 14 having a generally flat rectangular body 16 of a predetermined thickness including a top surface 18 and a bottom surface 20;

an X-shaped dome 22 generally formed from said first material 14 having an inner surface 24 and a outer surface 26;

four legs 28 of similar dimensions extending generally upwardly from each corner of the rectangular body 16 to a center axis of the dome extending over a predetermined area of the top surface 18 of the rectangular body 16, each leg fixedly attached generally at each distal end to one corner of the top surface 18;

a support member 30 connected to the top surface 18 at one end and extending upwardly inline with the center axis of the dome 22 from a point generally equidistance from each pair of opposing sides of the rectangular top surface 18 attached to the inner surface at the center axis of the dome 22 to further secure the dome 22 to the rectangular body 16;

an opening 34 between the top surface 18 of the rectangular portion 16 and the dome 22 on each side of the rectangular portion 16 for insertion of digit from a hand to grip and manipulate the tool by the end user, an inlay edge 36 generally along the perimeter of bottom surface 20 of the rectangular portion defining a second predetermined area, a chalk dust absorbing material 38 inset within the inlay edge 36 to fill the second predetermined area for collecting chalk dust in the billiard cloth through a capillary action to lift off of the billiard cloth and fill in amongst the fibers of the absorbent pad material 38.

10. The billiard chalk dust tool of claim 9, wherein the first material is a plastic, nylon, wood, rubber or other material that holds its shape when manipulated by a user hand as the billiard chalk dust tool is dragged or pushed across a cloth of a billiard table to collect the chalk dust.

11. The billiard chalk dust tool of claim 9, wherein the absorbent material is a polyester, cotton, or other fiber that creates an electrostatic action between the absorbing material and a baize to lift out the chalk dust in the baize and capture the chalk dust within the fiber when the absorbent material is rubbed over the baize of a billiard table.

* * * * *